US006194032B1

(12) United States Patent
Svedberg et al.

(10) Patent No.: US 6,194,032 B1
(45) Date of Patent: Feb. 27, 2001

(54) SELECTIVE SUBSTRATE METALLIZATION

(75) Inventors: Lynne M. Svedberg, Austin, TX (US); Kenneth C. Arndt, Fishkill, NY (US); Michael J. Cima, Winchester, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/165,366

(22) Filed: Oct. 2, 1998

Related U.S. Application Data

(60) Provisional application No. 60/060,906, filed on Oct. 3, 1997.

(51) Int. Cl.[7] ..... B05D 1/28; B05D 3/04; B05D 3/10; B05D 1/36

(52) U.S. Cl. ..... 427/304; 427/305; 427/437; 427/438; 427/443.1; 427/383.7; 427/260; 427/98; 427/125

(58) Field of Search ..... 427/304, 305, 427/383.7, 437, 438, 443.1, 260, 98, 125; 106/1.05, 1.13, 1.18, 1.21, 1.23, 1.24

(56) References Cited

U.S. PATENT DOCUMENTS

| | | | | |
|---|---|---|---|---|
| 4,139,604 | * | 2/1979 | Gutcho et al. | 424/1 |
| 5,158,604 | * | 10/1992 | Morgan et al. | 106/1.23 |
| 5,306,389 | * | 4/1994 | Smith et al. | 156/625 |
| 5,358,597 | | 10/1994 | Smith et al. | 156/625 |
| 5,405,366 | * | 4/1995 | Fox et al. | 607/50 |
| 5,443,658 | | 8/1995 | Hermanek | 148/23 |
| 5,470,381 | | 11/1995 | Kato et al. | 106/1.23 |

FOREIGN PATENT DOCUMENTS

| | | | |
|---|---|---|---|
| 366268 | * | 5/1990 | (EP) . |
| 0 366 268 | | 5/1990 | (EP) . |
| 618308 | * | 10/1994 | (EP) . |
| 0 618 308 | | 10/1994 | (EP) . |
| 54-4247 | | 1/1979 | (JP) . |
| 63-004074 | | 1/1988 | (JP) . |

OTHER PUBLICATIONS

"Electroless Plating of Metal Indicia on Metallic Susbtrate by Ink Jet Printing Method" JP 54004247, CA 90:213241 (1979).

Product Information of Gold Touch, Inc., No Date Available.

* cited by examiner

*Primary Examiner*—Shrive Beck
*Assistant Examiner*—Michael Barr
(74) *Attorney, Agent, or Firm*—Clark & Elbing LLP; Mary Rose Scozzafava

(57) ABSTRACT

A process for selective electroless plating onto a substrate, including providing a substrate having at least a catalytic surface; providing a plating gel comprising a carrier vehicle, an electroless platable metal compound capable of providing metal ions to the carrier vehicle at a specific pH, a reducing agent, and a polymeric thickening agent; applying said plating gel to the substrate surface in a selected pattern, and inducing plating of said metal on the substrate surface in said selected pattern. A stabilizer, and/or buffering and/or organic chelating agent, and/or surfactant and/or a humectant may be included in the plating gel. Preferably the metal compound is a gold complex, and the substrate is aluminum nitride.

33 Claims, 9 Drawing Sheets

GOLD CYANIDE PLATING GEL, [Au]=8g/l
GOLD PLATE IS POROUS AND NON-UNIFORM
2000X, SINGLE LAYER PRINT.

GOLD THIOSULFATE PLATING GEL, [Au]=8g/l
GOLD PLATE IS UNIFORM WITH LITTLE POROSITY,
2000X, SINGLE LAYER PRINT.

SEM CROSS-SECTION OF Ni/Au INTERFACE MOUNTED IN EPOXY 10,000X. (THICKNESS ~ 0.5 μm)

SEM CROSS-SECTION OF GOLD THIOSULFATE BASED PLATING SYSTEM (26-35).
[Au] = 40 g/L AND WET PRINT THICKNESS = 500 MICRONS.
GOLD PLATE IS APPROXIMATELY 1 MICRON. 5000X

SELECTIVE SUBSTRATE METALLIZATION

This application claims priority under 35 U.S.C. 5119(e) from U.S. Provisional application Ser. No. 60/060,906, filed on Oct. 3, 1997, which is entitled "Selective Substrate Metallization", and which is incorporated in its entirety by reference.

TECHNICAL FIELD

The present invention relates to selective metallization of parts. More particularly, it relates to the selective metallization of electrically isolated, catalytic features on a substrate which is susceptible to corrosion at high pH, such as partially metallized aluminum nitride substrates. The invention is generally applicable to many types of parts where selective metallization is desired.

BACKGROUND OF THE INVENTION

Diverse applications ranging from decorative coatings for jewelry and automotive parts to functional films in microelectronics utilize thin film technology. Thin film processes include vacuum deposition (evaporation, sputtering, chemical vapor deposition), spin coating and plating. Vacuum and spin coating processes require the use of photolithographic techniques to create the desired pattern. These processes can be labor intensive and not very economical for high volume coating processes.

Plating processes are more economical for metallizing large volumes of parts. Plating processes can be divided into two distinct types: electrolytic and electroless plating. Electrolytic plating is a standard process used to deposit a uniform metal thickness over electrically connected features. This process requires that the pattern to be plated is connected to an external power source by electrical leads. Part specific tooling is usually required to made reliable electrical connections to each part. Excess metallization is used to ensure all features are electrically connected and that uniform potential exists across the part during electrolytic plating. These excess metal features must be removed in a separate process. In addition, deposition of excess metal can lead to overplating and shorting of the electrical circuit. Terminators are often left that produce undesirable high frequency electrical characteristics. Therefore, electrolytic plating of electrically isolated regions is labor intensive and costly.

The electroless plating process deposits a uniform metal thickness over catalyzed features without the application of an external power source. This process takes advantage of thermodynamically feasible redox reactions between the catalyzed surface and chemical constituents in the electroless plating bath. A true autocatalytic electroless bath continues to build up a metal layer on the catalytic feature even after the initial surface has been completely covered by the metal that is being plated.

Electroless plating appears to be the most effective method for large scale, selective metallization; however, there are problems associated with commercial applications of some electroless plating solutions. Electroless bath chemistries are thermodynamically unstable and require very specific and precise formulations in order to maintain stability throughout numerous plating runs. Electroless baths also require careful maintenance because very low contamination levels can destabilize the bath. The baths are easily contaminated by the large volume of parts that are immersed into the plating solution. The costs associated with metal recovery, waste treatment, waste disposal; and maintenance costs of the large plating baths deter the use of electroless plating in many applications.

Another issue that arises is the compatibility of the bath chemistry with the material to be plated. For instance, commercially used autocatalytic electroless gold plating baths have a high pH to ensure stability of the reducing agent. These formulations can be corrosive to the material being plated.

In addition, the high pH electroless plating solutions destroy resist coatings used in the process. Masking techniques combined with successive runs in a plating bath are often used to achieve variation of metal thicknesses on the same substrate or to prevent plating on various areas of the substrate. The high pH electroless plating solutions destroy the resists often used in these masking applications.

Further, the high pH electroless plating solutions are cyanide-based. The health risks associated with such baths make them extremely undesirable. It would be advantageous to reduce or eliminate the cyanide levels in the electroless bath solution.

The problems associated with electrolessly gold plating selective areas of an aluminum nitride (AlN) substrate for microelectronic applications illustrate the limitations of the current electroless plating technology. AlN is a potential replacement for alumina in small, high power electronic devices. However, the commercially used electroless plating solution etches AlN because of its high pH. This corrosion rate is accelerated at the elevated temperatures used for plating operations. The surface properties of AlN are significantly altered during plating which not only damages the prior processing steps but also complicates further processing of the ceramic package. Any defectively plated parts add significantly to the final cost.

One approach to obtain an economical selective gold plating process compatible with AlN is to protect the exposed aluminum nitride surface from the corrosive plating solution. U.S. Pat. No. 5,306,389 discloses a method of protecting partially metallized aluminum nitride substrates during electroless plating in a gold electroless plating solution, by converting the exposed aluminum nitride to alumina through a surface oxidation treatment. This is counterproductive; however, as it is desirable to limit the presence of alumina on the AlN substrate since alumina has a lower thermal conductivity than AlN.

It is therefore desirable to develop a metallization process which avoids degradative reaction of the AlN surface.

Okinaka et al., *Plating*, September 1970, p. 914 and U.S. Pat. No. 3,700,469, disclose a typical autocatalytic electroless gold plating solution containing a gold-cyanide complex ($KAu(CN)_2$) that is reduced by a borane reducing agent, dimethylamine borane (DMAB). Such a bath has a pH around 14, a gold concentration of about 4 g/L and a plating temperature of about 82° C.

Mathe et al., *Metals Finishing*, January 1992, p. 34, disclose additives to an electroless plating bath (and their functions). Additive include stabilizers that inhibit the solution decomposition by masking active nuclei, buffers which maintain the proper pH, organic chelating agents that act as a buffer and/or prevent rapid decomposition.

Sullivan et al., *J. Electrochem. Soc., Vol.* 142, No. 7, July 1995, p. 2250, describes a non-cyanide, non-alkaline electroless gold plating bath in which sodium gold(I) thiosulfate ($Na_2Au(S_2O_3)$) is used as the gold complex and sodium L-ascorbic acid is used as the reducing agent. The bath has a pH of 6.4, deposition rates of 1 micron/hour and a plating temperature of 30° C. The non-toxicity and low pH of this bath makes it an attractive alternative to current cyanide alkaline baths, especially for AlN substrates. However, these baths are not as stable or reliable (note 30° C. deposition temperature) as the high pH cyanide baths currently used in manufacturing. U.S. Pat. No. 5,470,381 identifies a stabilizing agent which prevents rapid decomposition of the lower pH electroless gold plating solutions for gold concentrations of approximately 2 g/L; however, such gold concentrations are undesirably dilute.

Alternate selective metallization techniques that have been found in the literature include a technique which incorporates meltable salts into an ink that is printed onto a substrate using ink jet printing (Ishwar Ramchand Manshani, Japanese Patent S54-4247). This technique results in a flash deposit of metal on the substrate surface. Flash deposit occurs because of the galvanic displacement of the less noble metal substrate by the more noble metal in the ink. Therefore, this technique is not an autocatalytic plating process so the resulting metal deposit is limited to a very thin coating. The ink jet printing technique also is discussed in U.S. Pat. Nos. 3,465,350 and 3,465,351.

It is the object of the present invention to overcome the limitations of prior art electroless plating baths and operations described herein above.

It is a further object of the invention to eliminate or minimize etching and other surface defects associated with conventional high pH electroless plating operations and baths.

It is a particular object of the invention to provide an electroless bath and plating process for the plating of gold on AlN substrates.

It is a further object of the invention to provide an electroless bath and plating process which allows selective variation of metal thickness on the same substrate.

It is yet a further object of the invention to eliminate or minimize electroless plating bath maintenance and stability concerns.

It is a further object of the invention to provide a rework procedure for defectively plated substrates.

It is a further object of the invention to optimize the usage of metal in the deposition process.

It is a further object of the invention to reduce the volume of waste generated in the electroless plating process.

It is a further object of the invention to reduce the overall cost of the plating process.

It is a yet a further object of the invention to control deposition of the plated metal to minimize overplating problem encountered in conventional electroless plating operations.

SUMMARY OF THE INVENTION

These and other objects of the invention are realized in a metallization process that selectively places the plating solution only on the features to be plated and avoids contact with any exposed areas of substrate surface. This selective metallization process utilizes an electroless plating bath and a polymeric thickening agent to formulate a gel that can be placed only on desired features. By controlling the volume of reactants available to the substrate for deposition of metal layer, the thickness, location of deposition, degree of contamination and extent of overplating may be readily controlled.

The gel plating process of the present invention selectively plates metal on catalytic features without exposing sensitive areas of the substrate to a corrosive plating bath. This process utilizes an electroless plating bath comprising a thickening agent of a composition and in an amount to form a gel. The gel is selectively printed onto the areas of the substrate that require plating. The substrate is placed into a heated, humid environment in order to initiate and sustain the plating reaction. The gel is removed from the substrate after the metal has been deposited using a cleaning protocol compatible with the substrate surface.

By "gel" as that term is used herein, it is meant a composition which exhibits increased viscosity relative to a conventional plating bath solution. It is recognized that the actual viscosity and fluid properties of the gel may vary dependent upon the intended mode of application. Thus, for example, the gel may include a composition that retains its shape upon application and that exhibits non-Newtonian fluid mechanics, such as yield stress upon deformation. Alternatively, the gel may be a thickened solution that has Newtonian fluid mechanics, but which is sufficiently viscous to flow to maintain its shape for a time necessary for processing.

The gel includes those constituent components needed for deposition of a plated metal, such as a reducing agent and a metal complex. The reducing agent reduces the metal of the metal complex to form the plated metal. The gel also includes a thickening agent which is added to the plating solution to attain a suitable rheology for transferring the plating solution onto the substrate surface in a specific patterns and sustaining structural stability of the gel print. By "thickening agent", as that term is used herein, it is meant an agent which increases the viscosity of the composition to form a gel as described herein. The thickening agent may be a polymeric agent or a monomeric agent and is selected according to the needs of the application process. The gel may additionally include a buffer, for maintaining the pH of the gel, an organic chelating agent or a stabilizer, for preventing decomposition of the electroless plating gel and/or a humectant, for retaining moisture in the gel. A humectant is added to extend the lifetime of the printed gel prior to and during the deposition step.

Plating occurs autocatalytically at an elevated temperature by the simultaneous anodic oxidation of the reducing agent and the catalytic reduction of the metal complex on to the catalytic features of the substrate under the printed gel pattern. By "gel pattern or printed gel pattern" as those terms are used herein, it is meant the pattern of plating gel applied to the surface for the purpose of obtaining plated metal pattern. The present invention, therefore, provides a selectively metallized substrate, metallized directly under the areas which the gel was printed.

The present invention further provides a process for selective electroless plating onto a substrate, including providing a substrate having at least partially metallized surface which acts as a catalyst for the plating operation; providing a plating gel composition having a carrier vehicle; an electroless platable metal compound; a reducing agent; and a thickening agent; applying the gel to the substrate surface in a selected pattern; and inducing plating of the metal of the electroless platable metal compound on the substrate surface in the selected pattern.

The present invention further provides an electroless plating gel composition which includes a a carrier vehicle, an electroless platable metal compound, a reducing agent; and a thickening agent, said thickening agent in an amount sufficient to retain the gel integrity under electroless plating conditions.

The present invention is useful to replace currently used selective metallization processes with a selective area, electroless gel plating process. The present invention eliminates substrate etching problems conventionally associated with high pH electroless plating solutions, as it provides for selective placement of the plating gel on areas of the substrate subject to etching at high pH. The present invention allows selective variation of metal thickness on the same substrate, by the application of multiple plating steps with varying deposition area selection and coverage. Rework procedures for defectively plated substrates are possible, due to the capability of the process for multiple plating steps in selective areas.

The present invention eliminates electroless plating bath maintenance and stability concerns, as the plating gel is used one time, and can be stabilized in the short term by use of appropriate stabilizing, buffering, and/or complexing compound(s). The present invention optimizes the usage of metal in the metallization process, because only the small gel print on the substrate contains the metal compound, rather than a solution in which the entire substrate is immersed. Overplating problems encountered with conventional electroless plating is avoided by controlling the volume of reactants available to the substrate. Similarly, the volume of waste generated in conventional electroless plating processes is significantly reduced, lowering the overall cost of the plating process.

BRIEF DESCRIPTION OF THE DRAWING

The present invention is described with reference to the following Figures, which are presented for the purpose of illustration only and are in no way limiting of the invention and in which.

DETAILED DESCRIPTION OF THE INVENTION

Figure 1:
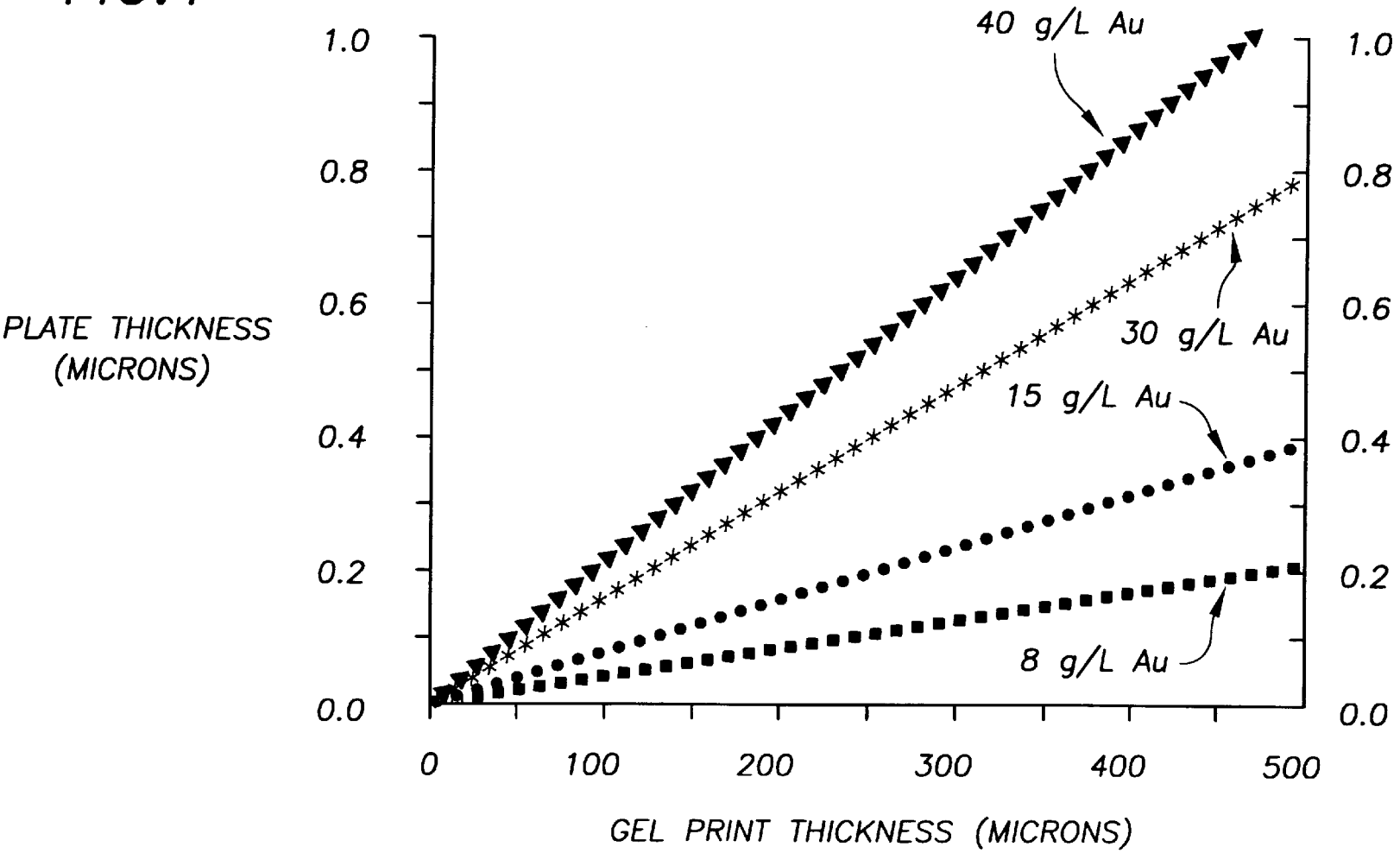
FIG. 1 is a graph illustrating the theoretical plate thickness achieved by the process of the present invention as a function of print thickness for various concentrations of gold in the gel.

The present invention provides a process for selective metallization of substrates, such as aluminum nitride, that are sensitive to high pH aqueous plating solutions or that require a variation of metal thickness on the same substrate. The invention avoids the problems which are commonly associated with exposure to high pH aqueous solutions in a corrosive electroless plating bath. As a result, processing steps needed to protect sensitive areas of the substrate from attack by components of the plating solution can be avoided, resulting in an economy of time and cost. The yield of acceptable parts is increased, undamaged by either the plating solution or the steps taken to protect, mask, and/or remove the mask and restore the substrates.

Instead of immersing the substrate in the plating solution, an electroless plating gel is provided which can be applied in a desired pattern by screen printing, pad printing or ink jet, brush application, either automatically or by hand, a felt pen, and offset printing, and the like, to selective portions of the substrate. Preferably the gel is applied to a previously metallized area of the substrate that acts as a catalyst, in order to deposit the metal of interest in the desired pattern. Of course, it is necessary to modify the electroless plating solution in order to make it capable of application to the substrate in this manner and to remain in place and in the selected pattern during the processing steps required to reduce the metal contained in it for the deposition onto the surface of the metallized substrate.

The gel is printed by appropriate means, such as by screen printing, pad printing or ink jet, brush application, either automatically or by hand, a felt pen, and offset printing, on the substrate in a defined pattern. The substrate with the printed gel pattern is then placed into an environmentally controlled deposition chamber, where reduction of the metal in the gel is induced, to deposit metal in a pattern dictated by the printed gel. Plating occurs autocatalytically at an elevated temperature by the transport of chemical reactants to the substrate surface. The reactants are transported by diffusion through the permeable, saturated gel matrix. The present invention therefore provides a selectively metallized substrate, metallized directly under the areas where the gel was printed.

According to the process of the present invention, an electroless plating bath formulation is modified to form a gel which functions as a "metal ink" carrier. The plating gel of the present invention may be used with any system known for the electroless plating of a metal. By way of example only, the plating gel may be formulated to plate gold, silver, nickel or copper. The gel contains all the ingredients of a typical electroless plating bath, including a metal complex which contains the metal to be plated and a reducing agent for reducing the metal complex to M(0). In addition, the gel contains a thickening agent to provide the rheological behavior necessary during application to the substrate and the structural rigidity needed during the processing steps, such as the reduction of the metal ion and its deposition as a metallic coating or layer on the surface of the substrate, or more particularly, on a catalytic feature on the surface of the substrate.

The thickening agent may be any material that thickens the plating gel and is compatible with and stable in the presence of the other components of the gel. The thickening agent may be a monomeric thickening agent. Suitable monomeric thickening agents include the family of glycols, such as ethylene glycol and propylene glycol. Such thickening agents do not provide a rigid gel and are particularly useful where that plating gel is to be administered by ink jet.

In another embodiment, the polymeric thickening agent may be any polymer which is compatible with the plating bath chemistry, such as for example a high pH and high ion concentration, and which is capable of forming a gel structure or thickening the composition in the metal complex solution under plating conditions. The polymer thickening agent may include, for example, but not by way of limitation, thickening agents from the families of cellulosics, such as hydroxypropyl methylcellulose, polysaccharides, polyethers, polyacrylimides and polyethylene oxide polymers. The thickening agent may be present in an amount in the range of about 0.01 wt % to about 20 wt % and preferably about 1 wt % to about 20 wt %.

A stabilizer, buffer, and organic complexing are typically also included to keep the metal salt complex in solution prior to the plating process, adjust the pH to desired operating value, and prevent decomposition of plating formulation during operation. Optionally, the gel may include a humectant, which gives the gel a lower vapor pressure than water, the preferred carrier vehicle for the plating bath components, and extends the lifetime of the printed gel prior to and during deposition.

A gel formulation is used that optimizes the printing and plating process. Electroless plating solutions for deposition of gold, nickel, copper, cobalt and palladium and alloys of gold-palladium can be found with pH values that range from the acidic (e.g., 1.5) to the alkaline (e.g., 14) pH regimes and all may be used within the scope of the invention. The pH is selected by adjusting the pH of the carrier vehicle and chemistry of the reducing agent usually dictates the desired operable pH.

In one embodiment, is it desirable to plate gold. Suitable gold complexes include, but are not limited to, sodium gold (I) cyanide, potassium gold (I) cyanide, sodium gold (III) cyanide, and potassium gold (III) cyanide. The pH of the metal complex solution is adjusted from about 12 to 14, preferably between about 13 and 14.

The reducing agent can be any reducing agent for the metal which will not deleteriously interact with the other components of the plating gel or the surface to be plated, and can include for example, but not by means or limitation, alkali metal borohydrides, dimethylaminoborane, triethylaminoborane, borane-tert-butylamine, dimethylamine borane, and borane pyridine.

The stabilizer, buffer, and organic chelating agents typically are included in the gel to keep the metal complex in solution prior to the plating process, to adjust the pH to the desired operating value, and to prevent decomposition of the plating bath. Suitable stabilizers, buffers and chelating agents are exemplified by, without being limited to, inorganic and organic compounds such as alkali metal cyanides, for example potassium cyanide or sodium cyanide, thiourea, sodium hydroxide, potassium hydroxide, potassium carbonate, sodium carbonate, and amino carboxylates such as ethlenediaminetetraacetic acid (EDTA) and nitrilotriacetic acid (NTA). A single compound may serve more than one of the functions of stabilizing, buffering and chelating. For example, the above listed hydroxides and carbonates are both stabilizing agents and buffering agents, while the amino carboxylates are both stabilizing agents and organic chelating agents The stabilizer balances the solution, keeping the metal compound soluble, and avoiding decomposition of the solution. It may be generally present in the amount of about $6\times10^{-7}$M to about 0.4M, preferably about $1.5\times10^{-3}$M to about 0.3M. The buffer is added in the amount needed to provide the desired pH, and is generally present in the amount of about 0.1 to about 0.5M, preferably about 0.3 to about 0.5M. The chelating agent, like the stabilizer and buffer, is related to the amount of metal compound, and is generally in the amount of about 0.01 to about 0.5M, preferably about 0.05 to about 0.3M.

In a further embodiment of the present invention, the plating gel is formed as a solution of a metal complex, a reducing agent, and a thickening agent to form a metal ink in a carrier vehicle. The pH of the metal complex is adjusted from about 6.5 to 8.5, preferably between about 7 and 8.5. The metal salt is a gold salt, including but not limited to sulfite or thiosulfate gold (I) complex salts, such as sodium gold (I) sulfite and potassium gold (I) thiosulfate A gold thiosulfate gel system is a preferred system system because it has a lower plating temperature and less health risks than the gold cyanide system.

The reducing agent can be any reducing agent for the metal which will not deleteriously interact with the other components of the plating gel or the surface to be plated, and can include for example, but not by means of limitation, dimethylamine borane, ascorbic acid, hypophosphite, and hydrazine.

The stabilizer, and/or buffer and organic chelating agent, may be desired to keep the metal complex in solution prior to the plating process, to adjust the pH to the desired operating value, and to prevent decomposition of the plating bath by impurities. These are exemplified by, without being limited to, inorganic and organic compounds such as alkali metal or ammonium sulfite or thiosulfate, 2-mercaptobenzothiazole, 6ethoxy-2-mercaptobenzothiazole, 2-mercaptobenzimidazole, 2-mercaptobenzoxazole and salts thereof, tartaric acid, citric acid, ammonium chloride, ammonium acetate, alkali metal hydroxides, and amino carboxylates such as ethylenediaminetetraacetic acid (EDTA) and nitrilotriacetic acid (NTA). As above, one compound may serve multiple functions of stabilizing, buffering, and chelating in the plating gel.

The polymeric thickening agent can be any polymer which is compatible with the plating bath chemistry including a high electrolyte concentration and pH of use, and is capable of forming a gel structure in the above solutions. The polymer thickening agent may include, for example, thickening agents from the families of cellulosics, such as hydroxypropyl methylcellulose and hydroxyethyl cellulose, polyacrylimides, polyethers, polysaccharides and polyethylene oxide polymers.

The humectant can be any humectant which is compatible with the polymeric thickening agent and the plating solution, such as without limitation glycols, such as propylene glycol, and γ-butyrolactone. The humectant may be present in an amount in the range of 0–40 wt %.

In preferred embodiments, a surfactant is included in the electroless plating gel to improve surface appearance of the substrate areas which are not plated. It has also been observed that use of a surfactant reduces adhesion of the gold onto overplated surfaces of the substrate. The surfactant can be any surface active agent which is compatible with the plating bath chemistry and is desirably stable at high electrolyte concentrations and pHs of use. The surfactant lowers the surface tension of the plating gel and reduces sporadic plating of gold on non-catalytic areas of the substrate onto which the gel is overprinted. The surfactant may include, for example, surfactants from the families of alkyl or aryl polyether alcohols or other non-ionic polymers.

The thickness of the gold plate after deposition is dependent on the gold concentration in the plating gel. FIG. 1 is a graph illustrating the effect of gold concentration in the plating gel on the final thickness of gold plate obtained. Commercial electroless gold baths usually have a gold concentration around 4 g/L. The gold concentration in commercial electroless plating baths is generally low, specifically 4 g/L, because an increase in the gold concentration usually decreases the stability of the plating solution. FIG. 1 shows that if a 500 $\mu$m thick gel print of this concentration (4 g/L) is deposited, the gold plate will be only approximately 0.1 $\mu$m thick. Therefore, the gold concentration in the plating gel is preferably greater than that in the prior art plating baths to obtain a gold plate with useful commercial applications.

A unique feature of the plating gel of the current invention is that the gold concentration in the plating gel can be raised above the normal concentration in commercial plating baths. In preferred embodiments, gold plating gels having a gold concentration of up to 40 g/L may be obtained, which represents a 10-fold increase over conventional plating baths. This is possible because the stability criteria for the two systems are different. The prior art electroless gold baths must remain stable at the plating temperature for many months and must be used for numerous plating runs. The inventive plating gel, however, is used only once. Contamination issues are less of a concern than in large plating baths because the plating gel is individually applied to each substrate. The only stability concern associated with the plating gel is that of shelf-life. Thus, a 40 g/L gold plating gel can produce a gold plate of 1 micron when a print thickness of 500 microns is used. Gold plate thicknesses in excess of 1 micron can be achieved by repeating the gel printing process of the present invention multiple times on the same substrate.

It should be understood that the thickness of the electroless deposit can be controlled by modifying the concentration of the plating metal in the plating gel, as well as the thickness of the gel print. The gold compound concentration in the gel is therefore in the range up to about 40 g/L or above. Gold concentrations of up to 80 g/mL are contemplated. Note, however, that when the gold salt concentration is increased, all other bath components should be increased accordingly.

A thickening agent is selected that is compatible with the plating components in the bath formulation. A commercial polymeric thickening agent is selected based on the following performance criteria: 1) compatibility of the polymeric thickening agent with the aqueous bath chemistry having a high electrolyte concentration, 2) "printability" of the plating gel, and 3) performance of gel structure at the plating temperature.

Figure 2:
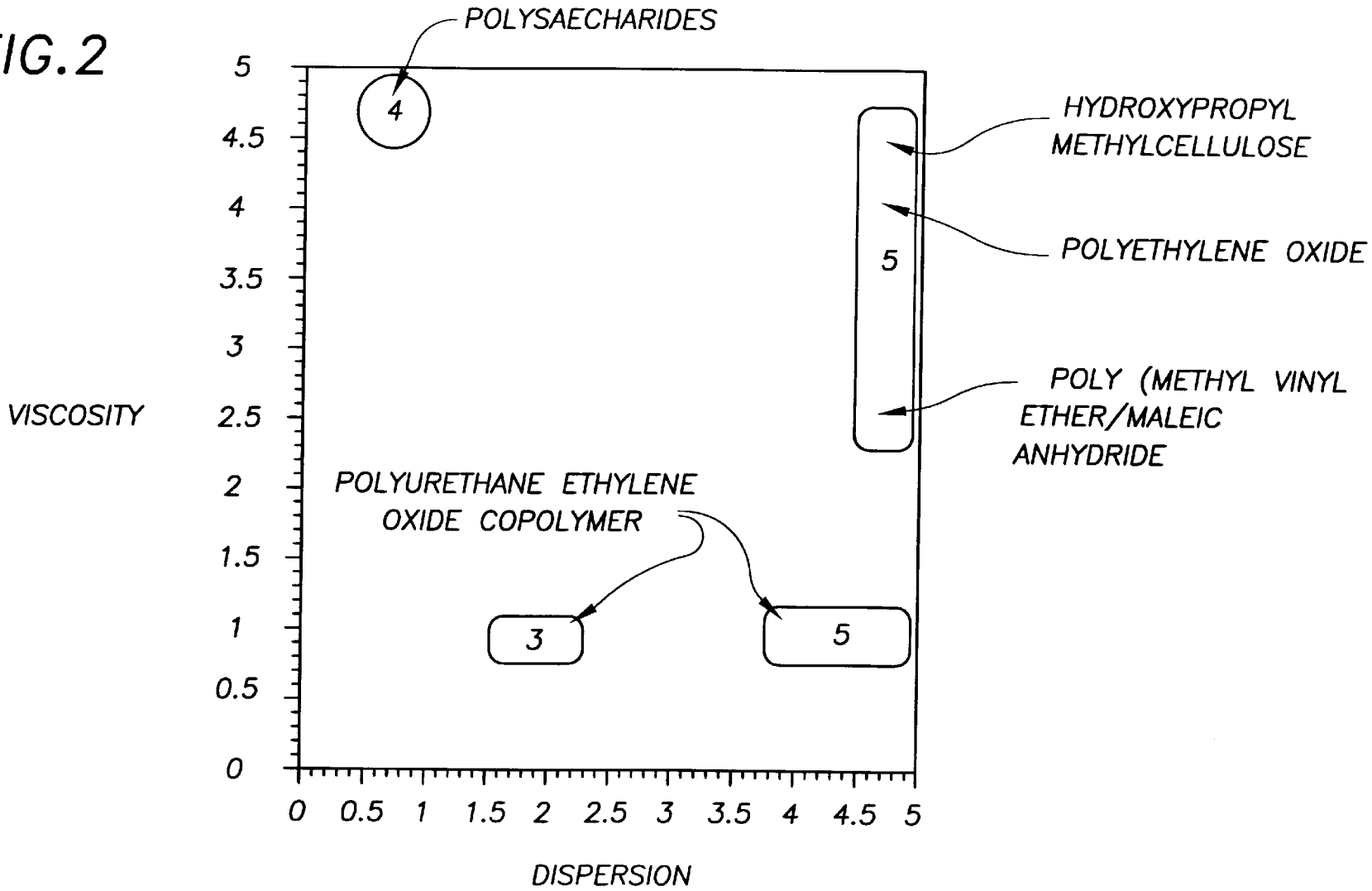
FIG. 2 is a graph illustrating the effect of polymeric thickening agents on the rheological properties of a high pH plating gel.

Commercial polymeric thickening agents were evaluated according to their dispersion, solubility, and viscosity in the plating solution. Many polymeric thickening agents would not thicken a plating solution with pH values greater than 12. The high ion concentration of these solutions interfered with the hydrating capabilities of the polymer powder. The solubility and dispersion of the polymer and the viscosity of the resulting solution were ranked on a scale from 0 to 5. A value of zero indicated that there were poor solubility, poor dispersion, and low viscosity; whereas, a value of five indicated excellent solubility and dispersion and an "ideal" viscosity. The "ideal" viscosity is tailored for the specific printing technique used. For example, if drop-on-demand ink jet printing was to be used, the viscosity of the ink should be 10-25 cP. For continuous ink jet printing, the viscosity should be 1–2 cP. Silk screening is anticipated to vary dependent upon screen mesh and other factors. FIG. 2 illustrates the performance of the thickening agents in a high pH gold bath which contains a gold metal complex and reducing agent. The bold numbers inside the oval regions in FIG. 2 identify the solubility ranking. The polyurethane/ethylene oxide co-polymers were eliminated because of their low viscosity. The poly(methyl vinyl ether/maleic anhydride) was eliminated due to its undesired reaction with the plating bath components. In other plating baths, particularly those of lower pH, these polymer thickening agents may be appropriate.

Figure 3:
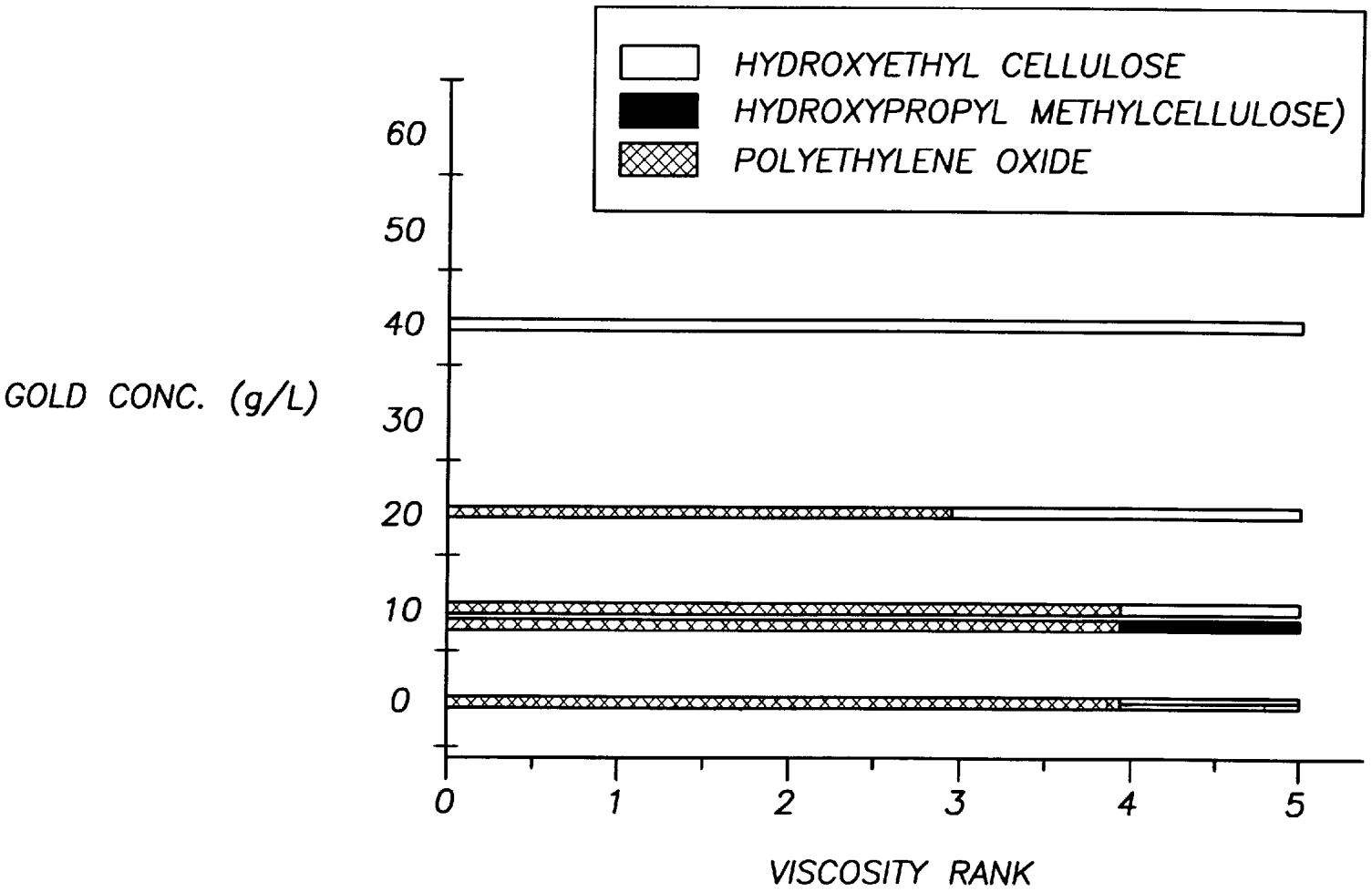
FIG. 3 is a graph illustrating the plating gel viscosity obtained form various thickening agents at specific gold concentrations.

The high electrolyte concentration required in the inventive plating gel interferes with the hydrating capabilities of the polymer and may degrade the thickening properties of the polymer—even in the lower pH plating solutions (pH between 6.5 and 8.5) Many polymeric thickening agents will not thicken a plating solution with a gold concentration in excess of 10 g/L gold. FIG. 3 illustrates the viscosity of the polymer solution as a function of gold concentration. A bar originating from a specific gold concentration extends to the viscosity attainable at the gold concentration with a specific thickening system. The hydroxypropyl methylcellulose thickeners are not preferred for this embodiment of high gold concentration gels because of their poor viscosity at higher gold concentrations.

The "printability" of the gel plating ink can be varied by using different types and concentrations of polymeric thickening agents, humectants and surfactants. Printability of the plating gel was evaluated by performance during silk screen printing. Silk screen printing of the plating gel requires that it have a low enough yield stress to allow the gel to flow during printing but high enough to retain the shape of the gel print at the plating temperature. It also must wet the surface to allow adhesion to the substrate but not to the screen during snap-off.

In preferred embodiments, the invention is directed to the electroless gold plating of catalytic features on substrates which would corrode under convention high pH electroless bath conditions. Most preferably the invention is directed to partially metallized aluminum nitride substrates. Other substrates to which the invention applies includes polymer and silicon substrates which have catalytic surfaces, but this specification will exemplify the invention with respect to its preferred embodiment, i.e., aluminum nitride substrates.

The substrate is treated to render it catalytically active to reduction in an electroless process. Any method which can be used to create a catalytic area on a substrate can be used within the scope of the invention. A catalytic area may be formed by depositing a layer, such as a metal layer, onto a region of substrate where plating is desired. Alternatively, a catalytic area may be obtained by selectively exposing the substrate (or a metal layer deposited onto the substrate) to an activating solution, such as palladium and platinum salts.

An aluminum nitride substrate may be at least partially metallized on its surface and preferably, although not necessarily, is metallized with a refractory metal. The refractory metal is not catalytic itself but can be made that way by depositing another layer of catalytic metal over it. In one embodiment the metallized surface contains a refractory metallized feature, such as a plane, a pad, pattern such as an island or street, or the like, which is formed by co-firing the substrate with at least one refractory metal feature or in a film deposition method. The refractory metallized feature generally comprises at least one of molybdenum and tungsten. The refractory metal feature is applied in a pattern for which one would like to electrolessly plate.

The refractory metallized feature is further coated with a metal layer such as nickel, which serves as the catalytic surface for the electroless gel plating process. A nickel layer may be formed by either electroplating or electroless plating a nickel layer onto at least a portion of the refractory metal pattern. The nickel layer can be further metallized with an immersion gold layer ranging between 10 to 150 angstroms, preferably 50 to 100 angstroms. The electroless gel plating process is able to plate gold on either of the above mentioned catalytic surfaces, which are nickel, gold, copper, palladium and platinum.

The plating gel can be printed onto the substrate by a conventional screen printer in a pattern defined by a stenciled emulsion or a metal stencil. The squeegee pressure, loading speed, and printing speeds can be adjusted according to known procedures to optimize the print thickness and quality. The wet deposit thickness can vary from less than 50 microns to greater than 500 microns.

The stenciled emulsion printing screen is generally made of two materials that have been laminated together. The first is a metal mesh which is stretched on a frame. The second material is a polymeric emulsion that defines the pattern and the thickness of the wet print. The metal mesh is defined by a mesh size, open area (%), type of material, and tension. The mesh size and the open area are responsible for the largest variations in the print quality. For the particular gels tested, a finer mesh (200+) with an open area of only 46% resulted in an unacceptable print; whereas, an 80 mesh (coarser) screen with an open area of 71% resulted in a good print.

The metal stencil can be made by either wet etching the correct thickness of metal in the desired pattern or by laser cutting the metal in the desired pattern. This type of screen limits the intricacy of the patterns that can be replicated with a metal stencil.

A hydroxypropyl methylcellulose polymer (see FIGS. 2–4) was determined to be an effective thickening agent for the high pH, low gold concentration plating bath. The performance of this gel also depends upon the molecular weight and concentration of the polymer added. The hydroxypropyl methylcellulose polymer (grade 15000) adhered to the screen during snap off, pulling the edges of the deposit closer to the middle, decreasing resolution. The hydroxypropyl methylcellulose polymer sample (grade 4000) completely released from the screen and no pull-back behavior was observed during snap-off. In addition, 6 weight percent of this polymer in the plating gel gave the rheological behavior necessary for successful printing and the structural rigidity needed during plating. The polymer thickening agent, according to the present invention, is in the range of about 1 percent to about 10 weight percent. The number average molecular weight of the polymer thickening agent is preferably about 86,000 to about 120,000.

Humectants may also be added to modify the performance of the gel during printing and deposition. Drying of the gel prior to or during deposition of the metal film has been found to alter the properties of the resulting plate, causing the plated metal to be non-uniform. Premature drying of the plating gel (i.e., before placement into the deposition chamber) can be reduced by adding a humectant, a material which lowers the vapor pressure of the system. The humectant changes the gel viscosity and modifies its behavior during printing and deposition. Bubbles formed during the printing of the gel when no humectant was used. The bubble formation prevents the reactants from reaching the surface of the activated metal layer; therefore, no deposition can occur. Propylene glycol was a preferred humectant system, compared to butyrolactone, when using the hydroxypropyl methylcellulose thickening system, due to its better structural rigidity at the plating temperature.

The humectant also can alter the gelation temperature of the polymer used. In preferred embodiments, a humectant raises the gelation temperature. The gelation temperature is the temperature at which the hydrated polymer will undergo syneresis. Syneresis occurs when the hydrated polymeric system expels solvent from its network. The network collapses leaving behind two separate phases, solvent and polymer. The resulting gold plate will not be uniform if syneresis occurs, because the collapsed polymer will restrict the transport of the reactants to the substrate surface. Additions of a humectant, preferably propylene glycol, raise the gelation temperature of the gel above that of the plating temperature. The humectant, according to the present invention, is preferably present in the range of about 0 weight percent to about 40 weight percent, more preferably about 5 to about 35 and preferably about 15 to about 20 weight percent.

Figure 4:
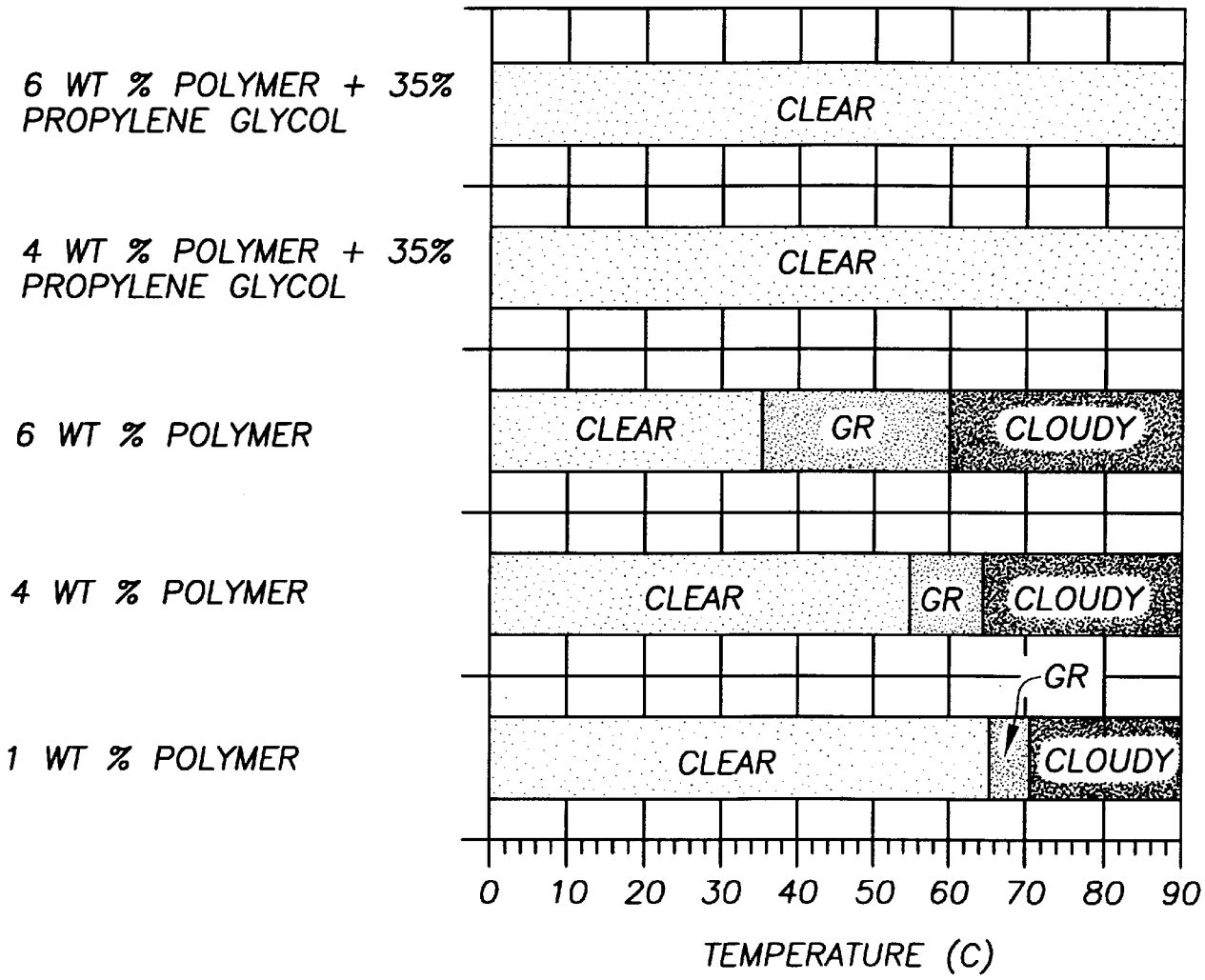
FIG. 4 is a graph illustrating the effect of propylene glycol humectant on the gelation temperature of a hydroxypropyl methylcellulose thickening agent in the gel formulation.

FIG. 4 illustrates the effect that the propylene glycol additions have on the gelation temperature. The plating gel is clear and viscous when the polymer is hydrated. The solution is cloudy and fluid when syneresis occurs. GR in FIG. 4 identifies the gelation range.

Figure 9:
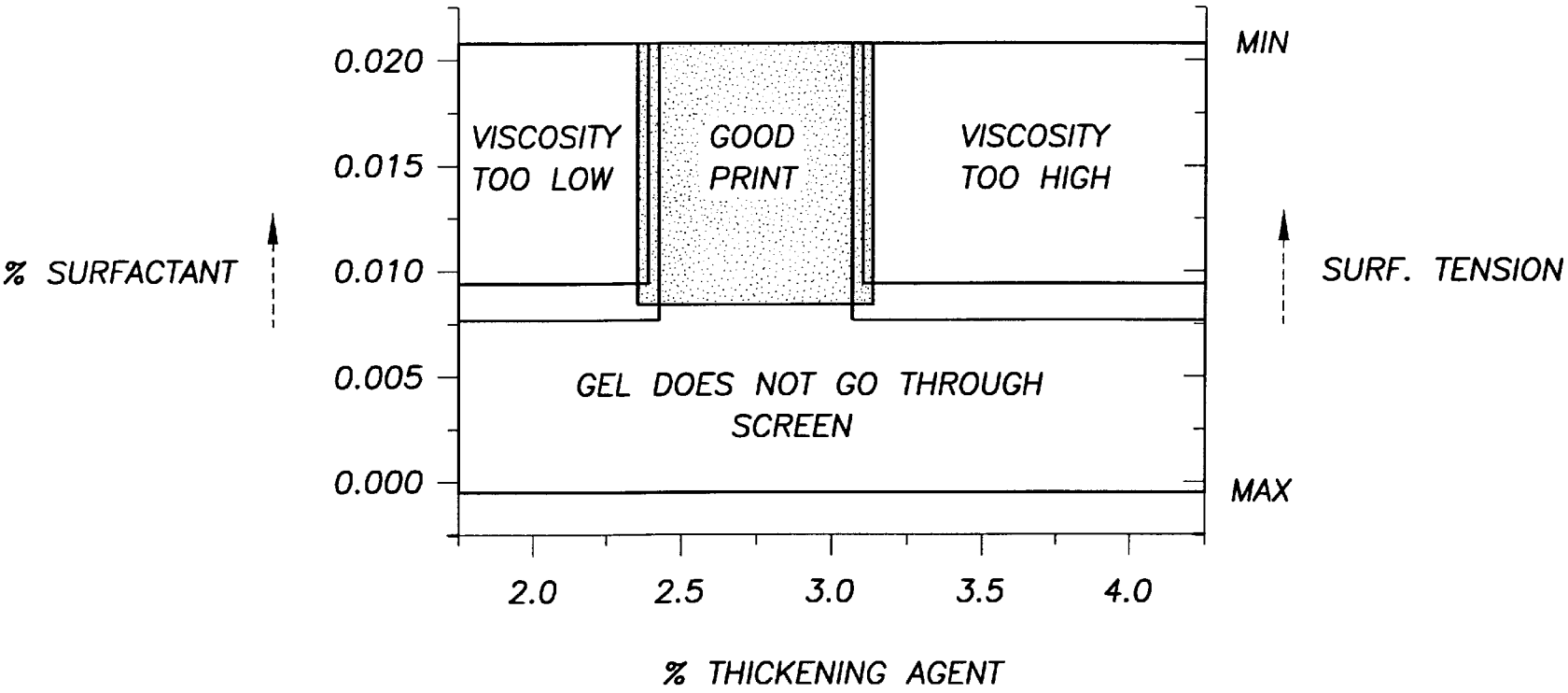
FIG. 9 is a graph illustrating the effect of surfactant level and thickening agent level on the printability of the electroless gel.

In another embodiment of the invention a surfactant may be included in the plating gel. A surfactant is added to reduce the surface tension of the gel which improves wettability of gel on the substrate surface. The ability to modify the surface wettability and printability of the gel increase the versatility of the system. FIG. 9 shows the effect that adding a surfactant has on the printability of the plating gel. The gel used for the poor print appears to pull off the substrate and adhere to the screen; whereas, the gel used in the good print adheres to the substrate and results in good gel print. The addition of a surfactant to the plating gel lowers the surface tension of the plating gel and enables the gel to adhere more to the substrate than the screen. The plating gel structure changes with temperature. Therefore, at 85° C., the plating gel relaxes and spreads. This decreases the feature resolution of the printed pattern. However, less spreading is observed at a plating temperature of 60° C.

A hydroxyethyl cellulose polymer was determined to be an effective thickening agent for the low pH, high gold concentration plating bath. As illustrated in FIG. 3, the hydroxyethyl cellulose and polyethylene oxide polymers were able to withstand higher electrolyte concentrations than the hydroxypropyl methylcellulose polymer. A plating gel with a gold concentration of 40 g/L can be formulated using 3 to 4 weight percent hydroxyethyl cellulose polymer. This plating gel performed well during screen printing and demonstrated the necessary structural rigidity at the plating temperature. A 500 micron print on this plating gel resulted in a gold plate thickness of 1 micron; see, FIG. 8. In preferred embodiments, a surfactant may be added to this formulation to reduce surface tension of the plating gel as described above. Reduction in surface tension increases the 'printability' of the plating gel by increasing the wetting of the gel onto substrate surface. In addition, humectants may be added to alter the gelation temperature or to provide other modifications to the gel bath. Therefore, the present invention provides a gold plate thick enough for useful application in commercial products. Other polymer thickening agents may be used according to the invention.

The gel print can be placed directly over catalytic features of the substrate or overprinted to include both catalytic and non-catalytic areas of the substrate. Specific pattern designs which have closely spaced features require that gel be printed over the catalytic features and the non-catalytic areas that separate the features. It is important for these closely spaced, electrically isolated lines that overplating does not occur which may electrically short these features. In traditional electroless gold plating baths, the reactants can be thought of as infinite for one substrate; however, in the gel plating process the reactants are limited by the volume of the gel print. This limits the severity of overplating that can occur for each part. Furthermore, addition of a non-ionic surfactant to the plating gel reduces the tendency for gold to sporadically plate on the over printed regions of the substrate which are non-catalytic. Specifically, surfactant reduces the amount of gold which sporadically deposits onto an AlN surface over which the plating gel has been printed.

The depositions of a uniform gold plate from the printed plating gel depends on its behavior at the plating temperature. For example, if the gel is printed uniformly over the catalytic features and the rheology of the gel provides sufficient structural stability at the plating temperature, then the diffusion of plating components to the substrate surface will be uniform and produce a uniform plate thickness. However, if the gel relaxes its shape at the plating temperature, the diffusion of components to the catalytic surface will be non-uniform depending on the final shape of the gel print. This will result in non-uniform plate thickness across the catalytic feature. The plating reaction occurs at the elevated temperature of 82° C. for the cyanide-based plating system and approximately 50–60° C. for the thiosulfate-based plating system. Therefore, the gold thiosulfate-based system demonstrates the more preferred gel structure at the lower plating temperature than does the cyanide-based system, because the structural rigidity of the gel decreases as the temperature increases and also drying of the gel is less of an issue at the lower temperature.

Both the cyanide and thiosulfate chemistries can be used with the gel plating process. The different chemical constituents require slightly different modifications to achieve the plating gel necessary for the present invention. However, the thiosulfate-based plating gel system offers many advantages over the cyanide-based plating gel system: the health concerns associated with cyanide are eliminated, the pH is reduced to a near neutral value, and the plating temperature is decreased.

It should be readily apparent to those skilled in the art, that the specific composition of the electroless gel may be modified to obtain the particular features and characteristics desired by the user. In particular, the choice of stabilizers, humectants, surfactants, etc., may be selected from those known in the art. The use of a plating gel may be used with any conventional electroless plating system.

EXAMPLES

Specific embodiments of the present invention will be described below in greater detail in the Example, which are presented for the purpose of illustration only and are in no way limiting of the invention:

Example 1

A cyanide-based plating gel was formulated by modifying a commercially available, Lectroless 2000, high pH electroless gold plating bath (distributed by Ethone-Omi) according to the following formulation:

| Constituent | Concentration (total vol. = 23 ml) |
|---|---|
| Unit A- Gold Solution | 6.0 ml |
| Unit B- Reducing Agent Solution | 4.67 ml |
| Deionized water | 4.25 ml |
| KCN | 0.31M |
| Hydroxypropyl methylcellulose (4000) | 6 weight percent |
| Propylene glycol | 8.05 ml |

The gold concentration of the modified plating bath was 8 g/L and the pH was about 13. The Unit A, Unit B, and KCN were combined with water and heated to between 80 and 85° C. Six (6) weight percent of they hydroxypropyl methylcellulose polymer (grade 4000) was dispersed in the heated, stirred solution. Propylene glycol was added to the solution and its viscosity increased instantaneously.

Aluminum nitride (AlN) substrates, about 0.25 to about 0.5 mm thick, having initially been metallized with a co-fire tungsten metallization pattern, and further metallized with a nickel layer, approximately 4 microns thick, having been electroplated over the tungsten metallization pattern, were used in the electroless gel plating process. The nickel portions of the substrate were activated first by removing the NiO layer by heat treatment in a forming gas atmosphere (5% $H_{2/95}$% $N_2$ or Ar) at 800° C. for 30 minutes. Subsequent activation included submersing the substrate in 50% HCl solution immediately before printing the plating gel onto the substrate.

The cooled plating gel was printed onto the AIN substrate using a screen printer and mesh/emulsion screen with a defined pattern. The wet print thickness was approximately 500 microns. The printed plating gel was directly over the catalytic nickel surface on the AlN substrate. The substrate was then placed into a reactor with a water-saturated nitrogen atmosphere and held at 82° C. for 1 hour.

The resulting gold plate was deposited directly under the gel print and directly on the catalytic nickel surface. No blistering was observed in the gold plate when heated to 390° C. at 10° C./min in a nitrogen atmosphere. The gold film demonstrated poor adhesion to the nickel layer.

Example 2

The gel plating process was performed as in Example 1 except that 5 to 20 g/L of ethylenediaminetetraacetic acid (EDTA) were added to the plating gel formulation.

Figure 5:
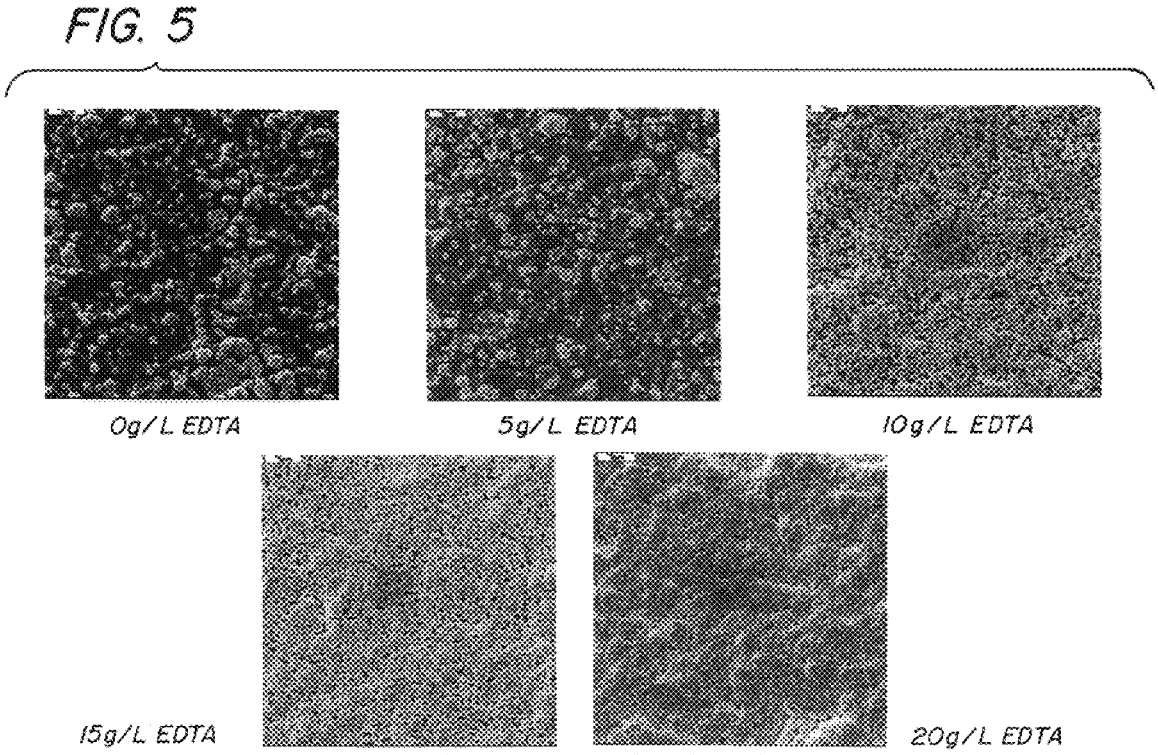
FIG. 5 is a series of photomicrographs illustrating the effect EDTA additions have on the gold plate microstructure from a cyanide-based plating gel.

The resulting gold plate from plating gels containing 15 to 20 g/L EDTA had better microstructural uniformity than the plate obtained in Example 1; see FIG. 5.

Important properties of the gold plate are color, dense microstructure, thickness, purity, strong adhesion. The color of gold plate can be a function of bath composition.

Additions of ethylenediaminetetraacetic acid, EDTA, to the cyanide-based plating system changes the plate color from a dark orange to a yellow gold color and improves the density of the gold microstructure.

Example 3

A cyanide-based plating gel with a gold concentration of 15 g/L was formulated as follows:

| Constituents | Concentration (total vol. = 15 ml) |
|---|---|
| $K[Au(CN)_2]$ | 0.078M |
| Dimethylamine Borane (DMAB) | 0.51M |
| KCN | 0.148M |
| EDTA | 0.083 |
| NaOH | 0.388M |
| Hydroxypropyl methylcellulose (4000) | 6 weight percent |
| Propylene Glycol | 19.4 weight percent |

This plating gel had a pH approximately 13. All constituents except the polymeric thickening agent and propylene glycol were dissolved in deionized water and heated to between 80 and 85° C. The hydroxypropyl methylcellulose polymer was dispersed in the heated, stirred solution. Propylene glycol was added to the solution and the viscosity increased instantaneously. The plating gel was printed using the same procedure as in Example 1 and the same substrates as described in Example 1.

Example 4

A thiosulfate-based plating gel with a gold concentration of 8 g/L was formulated as follows:

| Constituents | Concentration (tot. vol. = 20 ml) |
|---|---|
| $Na_3Au(S_2O_3)_2$ | 0.041M |
| Ascorbic Acid ($C_6H_8O_6$) | 0.068M |
| Citric acid | 0.105M |
| NaOH | 0.425M |
| EDTA | 0.05M |
| Propylene glycol | 7 ml |
| Hydroxypropyl methylcellulose (4000) | 7 weight percent |

This plating gel had pH value of approximately 6.5. All constituents except propylene glycol and hydroxypropyl methylcellulose were combined with water at room temperature. The hydroxypropyl methylcellulose was added to the propylene glycol separately. The aqueous plating solution was then added to the polymer/propylene glycol mixture. The viscosity of the final solution increased instantaneously.

Figure 6:
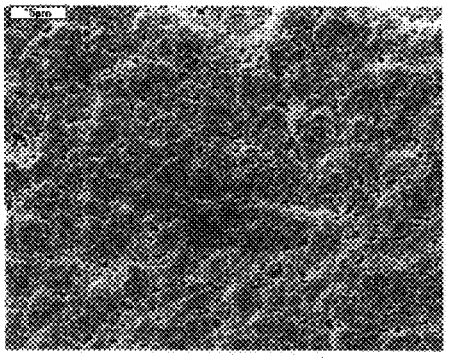
FIG. 6 is a comparison of the gold microstructures obtained from the cyanide-based plating gel ([Au]=8 g/L; 2000×, single layer print) showing porous and non-uniform surface and the thiosulfate-based plating gel ([Au]=8 g/L; 2000×, single layer print) showing uniform surface with little porosity.
Figure 6:
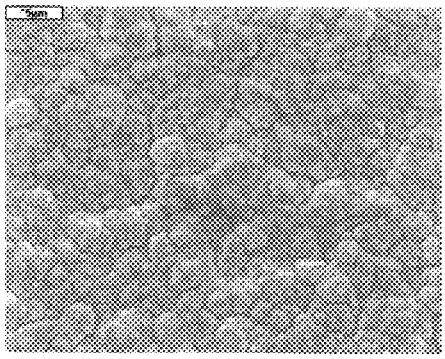
Figure 7:
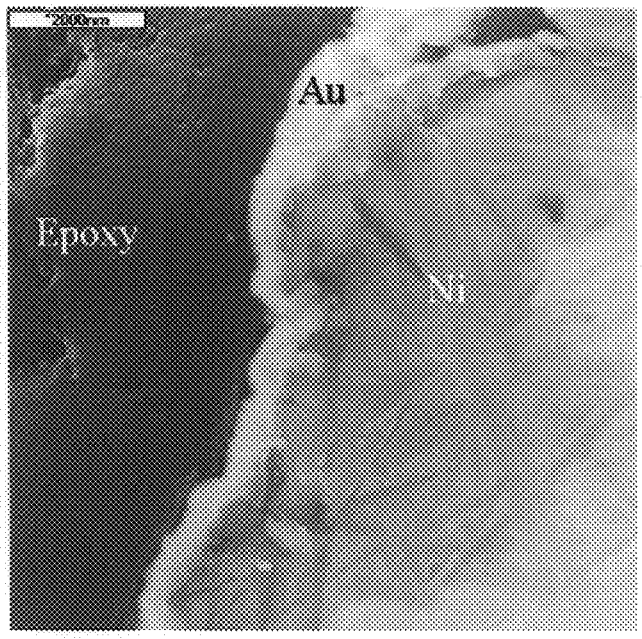
FIG. 7 is a SEM cross-sectional photomicrograph illustrating the plate thickness obtained from a gold thiosulfate-based plating gel in Example 4 (mounted in epoxy; 10,000×; thickness ~0.5 μm)

The plating gel was printed in the same manner as Example 1 onto the same substrates used in Example 1. Plating took place in the reactor described in Example 1, but at a plating temperature of 50° C. FIG. 6 compares the resulting microstructures from a cyanide-based plating gel and a thiosulfate-based plating gel. The thiosulfate-based plating gel has a more uniform and desired microstructure. Cross-sectional SEM (FIG. 7) and XRF measurement of the gold plate thickness revealed that the gold plate was actually thicker than expected due to a gel print thickness in excess of 500 microns. This plating gel decomposes at room temperature after a few days.

Example 5

A thiosulfate plating gel with a gold concentration of 40 g/L was formulated as follows:

| Constituents | Concentration (tot. vol. = 10 ml) |
|---|---|
| $Na_3Au(S_2O_3)_2$ | 0.2M |
| $C_6H_8O_6$ | 0.7M |
| $(NH_4)S_2O_3$ | 0.2M |
| $Na_2SO_3$ | 0.15M |
| Di-ammonium EDTA | 0.3M |
| $NH_4Cl$ | 0.5M |
| NaOH | 0.29M |
| 2-mercaptobenzimidazole | $3 \times 10^{-3}$M |
| Hydroxyethyl cellulose | 3.7 weight percent |

This plating gel had a pH approximately 7.5. All constituents were combined in water with the hydroxyethyl cellulose powder added last. After approximately 10 minutes, the solution reached the desired viscosity.

The plating gel was printed in a similar manner to that described in Example 1. The substrates used were similar to those described in Example 1 except that the nickel layer was further metallized with an immersion gold layer approximately 100 nm thick.

A commercial humidity oven was used for the deposition step in place of the reactor. The plating temperature was 50° C. with 90 percent humidity. The gel did not dry in the commercial humidity oven.

Figure 8:
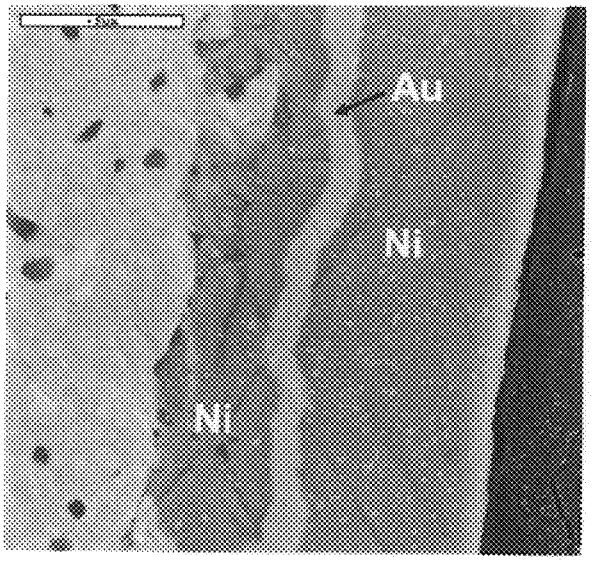
FIG. 8 is a SEM cross-sectional photomicrograph illustrating the 1 micron plate thickness obtained from a 500 micron print of a thiosulfate-based plating gel with 40 g/L gold concentration (Example 5); wet press thickness=550 μm; gold plate −1 μm; 5000×.

The resulting gold plate was uniform and a yellow gold color. FIG. 8 shows that the thickness of this gold plate was approximately 1 micron. The adhesion was greatly improved when an immersion gold layer was used which had undergone a diffusion treatment to increase the adhesion between the nickel and gold layers.

Example 6

A thiosulfate-based plating gel with a gold concentration of 8 g/L was formulated according to Example 4. The plate thickness from a 500 micron wet print was approximately 0.2 microns. Multiple printing was performed in order to increase this plate thickness. The plating gel was initially printed according to the method described in Example 1 on substrates described in Example 1. The deposition step was performed according to the method presented in Example 1 at a plating temperature of 50° C. for 1 hour. After the excess gel was rinsed from the substrate, the above printing and deposition steps were repeated four times, increasing the thickness of the gold plate.

Example 7

A thiosulfate-based plating gel with a gold concentration of 40 g/L was formulated as follows:

| Constituents | Concentration |
|---|---|
| $Na_3Au(S_2O_3)_2$ | 0.2M |
| Ascorbic Acid ($C_6H_8O_6$) | 0.7M |
| Ammonium Acetate | 0.5M |
| Sodium Sulfite | 0.15M |

-continued

| Constituents | Concentration |
|---|---|
| EDTA | 0.008M |
| 2-mercaptobenzimidazole | $7.5 \times 10^{-4}$M |
| Hydroxyethyl Cellulose | 3.5 weight percent |

This plating gel had a pH value of 7.5. All constituents were added to water at room temperature with hydroxyethyl cellulose being the last constituent added. The solution thickened to a gel within 10 minutes.

The substrate used was a rectangular nickel coupon that had been immersion plated with a layer of gold approximately 0.01 microns thick. The plating gel was printed onto this substrate using a metal stencil which had a rectangular printed feature that was 0.9×0.4 inches. The gel print was approximately 1 millimeter thick. The sample was inserted into a commercial humidity oven at a temperature of 60° C. and 97% humidity for 150 minutes. The resulting plate thickness was 0.625 (+/−) 0.039 microns obtained from X-Ray Fluorescence (XRF) measurements.

Example 8

A thiosulfate-based plating gel with a gold concentration of 40 g/L gold was formulated as follows:

| Constituents | Concentration |
|---|---|
| $Na_3Au(S_2O_3)_2$ | 0.2M |
| Ascorbic Acid ($C_6H_8O_6$) | 1.0M |
| Ammonium Acetate | 0.5M |
| Sodium Sulfite | 0.15M |
| EDTA | 0.046M |
| 2-mercaptobenzimidazole | $7.5 \times 10^{-5}$M |
| Hydroxyethyl Cellulose | 3.5 weight percent |

This plating gel had a pH value of approximately 7.0. All constituents were added at room temperature with the hydroxyethyl cellulose being added as the last step. This solution thickened in approximately 12 minutes.

The substrate used was an AlN substrate with metallized lines. The metallized lines were in a pattern such that three immersion gold plated lines were separated by thin areas of AlN. In order to metallize these three gold lines, the plating gel was over printed onto the AlN regions of the substrates. The plating gel was applied using a metal stencil screen approximately 250 microns thick. Five (5) multiple prints were done to achieve the desired plate thickness. The sample with the printed gel (approximately 800 to 900 microns) was placed into a commercial humidity oven at 60° C. and a humidity of 97%. Each layer had a plating time of approximately 45 to 60 minutes. The final plate showed undesired plating of gold onto the AlN surface where the gel was overprinted. Profilometry showed the final gold thickness to approximately 1.7 microns.

Example 9

A thiosulfate-based plating gel with a gold concentration of 40 g/L gold was formulated as follows:

| Constituents | Concentration |
|---|---|
| $Na_3Au(S_2O_3)_2$ | 0.2M |
| Ascorbic Acid ($C_6H_8O_6$) | 0.7M |
| Ammonium Acetate | 0.5M |
| Sodium Sulfite | 0.15M |
| EDTA | 0.008M |
| Octylphenoxypolyethoxyethanol | $2.95 \times 10^{-7}$M |
| 2-mercaptobenzimidazole | $7.5 \times 10^{-4}$M |
| Hydroxyethyl Cellulose | 3.5 weight percent |

This plating gel had a pH value of approximately 7.5. All constituents were added at room temperature with the hydroxyethyl cellulose being added as the last step. This solution thickened in approximately 10 minutes.

The substrate used was similar to that in Example 8. The plating gel was again overprinted onto AlN regions of the substrate surrounded by metal lines. Three (3) multiple prints were used to build up the desired plate thickness. Each layer was placed into a custom built reactor at 60° C. with a saturated nitrogen atmosphere for approximately 3 hours. The resulting gold plate showed less gold plated onto the AlN regions of the substrate. Inspecting the substrate under the optical microscope after ultrasonicating the substrate in DI water showed no harmful plating of gold onto the AlN substrate. Weight change measurements demonstrated that this gold plate is approximately 2 microns thick. The difference between this result and that of Example 8 was the addition of a non-ionic surfactant (octylphenoxypolyehtoxyethanol).

Example 10

A thiosulfate-based plating gel with a gold concentration of 4 g/L was formulated as follows:

| Constituents | Concentration (total vol. 15 ml) |
|---|---|
| $Na_3Au(S_2O_3)_2$ | 0.02M |
| Ascorbic Acid ($C_6H_8O_6$) | 0.03M |
| Sodium Sulfite | 0.005M |
| Propylene Glycol | 35 weight percent |
| Hydroxypropyl Methylcellulose | 6 weight percent |

This plating gel had a pH of 5.5. The plating gel was formulated as in Example 3. The plating gel was printed onto a nickel substrate and placed into the reactor described in Example 1 at a plating temperature of 600° C. for 20 minutes. Resulting gold plate is dark in color. Plating gel decomposed at room temperature within 16 hours.

It is therefore demonstrated that the objects of the present invention are met by the examples as set forth above. The present invention is not to be limited by those examples however, which are provided merely to demonstrate the invention. For example, substrates, electroless metals, reducing agents, stabilizers, buffers, complexing agents, polymer thickeners, humectants, carrier vehicles, and operating parameters other than those exemplified herein fall within the scope of the present invention, which includes all embodiments defined by the following claims and their equivalent embodiments.

We claim:

1. A process for selective electroless plating of a metal onto a substrate, comprising:

(a) providing a substrate having a surface which is catalytic to electroless plating;

(b) applying an electroless gel plating composition to selected areas of the substrate in a selected pattern, said gel plating composition comprising:

(i) a carrier vehicle;

(ii) an electroless platable metal compound;

(iii) a reducing agent; and (iv) a thickening agent sufficient to form a gel having a yield stress that allows the gel to flow under conditions of application to the substrate and which maintains its yield stress under electroless plating conditions so as to retain its structural rigidity; and (c) inducing plating of the metal of the electroless platable compound on the substrate surface at the selected pattern.

2. The process of claim 1, wherein electroless plating occurs at a plating temperature in the range of 50 to 85° C.

3. The process of claim 1, wherein electroless plating occurs at a temperature in the range of 50–60° C. and for a time in the range of 45 to 150 minutes.

4. The process of claim 1, wherein the thickening agent comprises a polymeric thickener.

5. The process of claim 4, wherein the polymeric thickener is selected from the group consisting of cellulosics, polysaccharides, polyethers, polyethylene oxides, and polyacrylimides.

6. The process of claim 1, wherein the thickening agent comprises a monomeric thickener.

7. The process of claim 6, wherein the monomeric thickener comprises a glycol.

8. The process of claim 1, wherein the substrate is an insulating ceramic substrate.

9. The process of claim 1, wherein the substrate is a plastic substrate.

10. The process of claim 1 wherein the plating gel further comprises a humectant.

11. The process as in claim 10 wherein the humectant is selected from the group consisting of propylene glycol and γ-butyrolactone.

12. The process of claim 1, wherein the plating gel further comprises one or more of the additives selected from the group consisting of buffers, stabilizers and chelating agents.

13. The process of claim 11, wherein the plating gel further comprises a surfactant.

14. The process of claim 13, wherein the surfactant is selected from the group consisting of alkyl and aryl polyether alcohols.

15. The process of claims 1, wherein the catalyzed surface comprises an area activated by activating salts.

16. The process of claim 1, wherein the electroless gel plating composition is applied in the selected pattern using a technique selected from the group consisting of screen printing, ink jet printing, offset printing and brush application.

17. The process of claim 1, wherein the pH of the gel plating composition is in the range of about 12 to about 14.

18. The process of claim 17, wherein the electroless platable metal compound is selected from the group consisting of sodium gold (I) cyanide, potassium gold (I) cyanide, sodium gold (III) cyanide, and potassium gold (III) cyanide.

19. The process of claim 1, wherein the electroless plating composition has a pH in the range of about 6.5 to about 8.5.

20. Thc process as in claim 1, wherein the electroless platable metal compound is selected from the group consisting of sodium gold (I) sulfite and potassium gold (I) thiosulfate.

21. The process of claim 1, wherein the electroless gel plating composition is applied to the substrate at a thickness in the range of 50 microns to 500 microns.

22. The process of claim 1, further comprising:

repeating step (b) and step (c) one or more times to increase the thickness of the electroless metal plating in the selected pattern.

23. The process of claim 1, wherein the thickness of the plated metal is in the range of 0.1 to 2 microns.

24. A process for selective electroless plating of gold onto a substrate, comprising:

(a) providing a substrate having a surface which is catalytic to electroless plating;

(b) applying an electroless gel plating composition to selected areas of the substrate in a selected pattern, said gel plating composition comprising:

(i) a carrier vehicle;

(ii) an electroless platable gold-containing compound having a gold concentration of greater than or equal to 8 g/L;

(iii) a reducing agent; and (iv) a thickening agent sufficient to form a gel having a yield stress that allows the gel to flow under conditions of application to the substrate and which maintains its yield stress under electroless plating conditions so as to retain its structural rigidity; and (c) inducing plating of the metal of the electroless platable compound on the substrate surface at the selected pattern.

25. The process of claim 24, wherein the gold concentration is greater than or equal to 15 g/L.

26. The process of claim 24, wherein the gold concentration is greater than or equal to 40 g/L.

27. The process of claim 24, wherein the gold concentration is in the range of about 8 g/L to about 80 g/L.

28. The process of claim 24, wherein the thickening agent is selected from the group consisting of cellulosics and polyethylene oxide.

29. The process of claim 24, wherein the amount of thickening agent in the gel is about 0.01 weight percent to about 20 weight percent.

30. The process of claim 24, wherein the substrate comprises aluminum nitride.

31. The process of claim 1 or 24, wherein the catalyzed surface of the substrate is in the form of the selected pattern on which it is desired to plate the electroless platable metal.

32. The process of claim 31, further including the step of:

plating a catalyzing metal layer onto at least a portion of the substrate to form the catalyzed surface of the substrate.

33. The process of claim 32, wherein the catalyzing metal is selected from the group consisting of nickel, gold, copper, palladium and platinum.

* * * * *

UNITED STATES PATENT AND TRADEMARK OFFICE

CERTIFICATE OF CORRECTION

PATENT NO. : 6,194,032 B1
DATED : February 27, 2001
INVENTOR(S) : Lynne M. Svedberg et al.

It is certified that error appears in the above-identified patent and that said Letters Patent is hereby corrected as shown below:

Column 1,
Line 3, replace "U.S.C. 5119(e)" with -- U.S.C. §119(e) --;

Column 2,
Line 64, replace "($Na_2Au(S_2O_3)$)" with -- $Na_2Au\ (S_2O_3)_2$) --;

Column 7,
Line 64, replace "agents" with -- agents. --, and begin a new paragraph after "agents.";

Column 12,
Line 2, replace "butyrolactone" with -- γ-butyrolactone --;

Column 14,
Line 28, replace "(5% $H_{2/95}$% $N_2$" with -- (5% $H_2$/95% $N_2$ --;

Lines 50-52, remove indentation of "The resulting gold plate...", making it a continuation of the same paragraph as "the plating gel formation";

Lines 57-59, make one paragraph by putting "Additions of. . ." after "bath composition.";

Column 16,
Line 64, replace "($C_6H_8O_6$)" with -- ($C_6H_8O_6$) --;

Column 17,
Line 52, replace "AIN" with -- A1N- -.

Signed and Sealed this

Twenty-first Day of May, 2002

*Attest:*

*Attesting Officer*

JAMES E. ROGAN
*Director of the United States Patent and Trademark Office*